United States Patent [19]

Robinson et al.

[11] 4,111,009

[45] * Sep. 5, 1978

[54] KNITTING METHOD AND ARTICLE FOR A BODY PANEL

[75] Inventors: Frank Robinson, Breaston; Keith Harry Girt, Menstone, near Ilkley; Nigel Stephen Whatmough, Breaston, all of England

[73] Assignee: Courtaulds Limited, London, England

[ * ] Notice: The portion of the term of this patent subsequent to May 9, 1995, has been disclaimed.

[21] Appl. No.: 713,425

[22] Filed: Aug. 11, 1976

[30] Foreign Application Priority Data

Aug. 12, 1975 [GB] United Kingdom ..... 33520/75

[51] Int. Cl.[2] ..... D04B 7/10; D04B 7/22; D04B 7/30; A41D 1/04

[52] U.S. Cl. ..... 66/189; 66/176; 66/172 R; 2/90

[58] Field of Search ..... 66/189, 176, 169, 170, 66/171, 172 R, 200; 2/90

[56] References Cited

U.S. PATENT DOCUMENTS

| | | | |
|---|---|---|---|
| 412,054 | 10/1889 | Williams | 66/176 |
| 957,854 | 5/1910 | Mueller | 66/176 |
| 2,053,985 | 9/1936 | Collins et al. | 66/170 X |
| 2,126,186 | 8/1938 | Friedland | 2/90 |
| 2,222,946 | 11/1940 | Hall | 66/177 |
| 2,618,139 | 11/1952 | Silman | 66/176 |
| 3,474,643 | 10/1969 | Robinson et al. | 66/189 X |
| 3,602,914 | 9/1971 | Castello | 2/90 |
| 3,640,097 | 2/1972 | Betts et al. | 66/176 |
| 3,813,901 | 6/1974 | Betts et al. | 66/189 |
| 3,824,810 | 7/1974 | Betts et al. | 66/189 X |
| 3,882,696 | 5/1975 | Jeffcoat et al. | 66/172 R |

FOREIGN PATENT DOCUMENTS

| | | | |
|---|---|---|---|
| 1,046,337 | 12/1953 | France | 2/90 |
| 1,371,497 | 10/1974 | United Kingdom | 66/177 |

OTHER PUBLICATIONS

Dubied Knitting Manual, Neuchatel, Switzerland, 1967, pp. 57–58.

*Primary Examiner*—Mervin Stein
*Assistant Examiner*—Andrew M. Falik
*Attorney, Agent, or Firm*—Davis, Hoxie, Faithfull & Hapgood

[57] ABSTRACT

A method of manufacturing a knitted garment to cover at least the upper body, for example a jacket, involves knitting two front panels to form the front of the garment, each of these panels being started from a non-run set-up, and incorporating each of these front panels in a garment so that the line of each of the non-run set-ups is located in the front of the garment and extends in an up-and-down line when the garment is worn, whereas the knitted wales of each of the panels extend from the set-up line of the panel, horizontally in the garment when worn, to an associated side of the garment front. Each front panel may incorporate a strip of fabric, disposed in an up-and-down direction when the garment is worn, which is distinguished from the main part of the panel by color and/or stitch structure.

Methods of joining the front panels to sleeve panels, and the sleeve panels to one or more rear panels, on a knitting machine are described.

7 Claims, 4 Drawing Figures

KNITTING METHOD AND ARTICLE FOR A BODY PANEL

Figure 1:
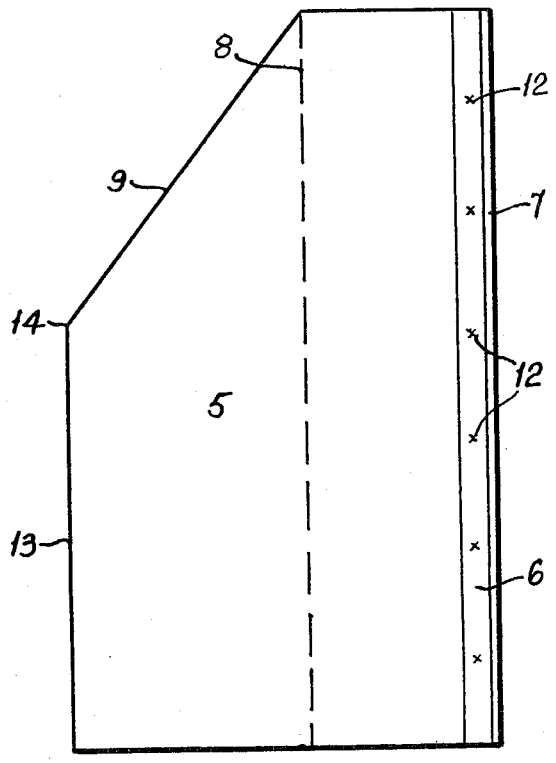

The present invention relates to the manufacture of knitted garments for the upper body and provides a construction for such garments which facilitates their manufacture.

According to the invention, a method of manufacturing a knitted garment to cover at least the upper body comprises knitting two front panels to constitute the front of the garment, starting each panel from a non-run set-up, and incorporating said two front panels in a garment so that the line of each of said set-ups is located in the front of the garment and extends in an up-and-down line in the garment, when worn, whereas knitted wales of each of said panels extend from said set-up line of the panel, horizontally in the garment, when worn, to an associated side of the garment front.

The invention includes a knitted garment to cover at least the upper body, comprising two front panels each constituting a part of the front of the garment and having wales extending horizontally from an up-and-down line in the garment, when worn, to an associated side of the front, each of said lines being located in the front of the garment and lying along a non-run set-up at which the knitting of the respective panel was begun.

Each panel may be shaped by knitting on from an edge portion of the panel which includes or consists of said set-up on some only of the needles holding loops of the edge portion and introducing further inactive needles holding loops of the edge portion into knitting action during the knitting process.

Each panel may, alternatively or in addition, be shaped at a position or positions remote from said set-up by taking needles out of action during the knitting process and either casting off the loops on those needles or holding the loops on the needles taken out of action. Such shaping may provide an edge of the panel inclined to the direction of the courses in the panel to serve as a line along which the panel may be joined to a sleeve of a garment.

The said set-up may be constituted by a welt and said edge portion may consist exclusively of a welt or it may comprise a welt followed by a further strip of fabric. Said fabric may be distinguished from the fabric of the main portion of the body panel by colour or stitch structure.

Advantageously, knitting of the set-up is begun on bare needles and on completion of the panel, the needles may be operated to cast off their loops and free the panel from the needles. Alternatively, needles holding loops of the panel may be taken out of action progressively along a sleeve-body join line in the panel and these needles may be brought progressively back into action to knit a sleeve panel integral with the front panel, at least above the arm pit region. A similar progressive holding up and reintroduction of the needles may be employed to join the sleeve panel thus knitted to a further body panel, or part of a body panel, of the garment.

Two mirror-image pieces of knitted fabric produced in this way and each incorporating sleeve and body panels integrally joined in the manner just described may be made up into a garment comprising three pieces of fabric, that is two pieces of fabric each comprising a front panel and a sleeve panel and a further piece of fabric constituting a rear panel for the garment. As another alternative, the garment may comprise two pieces of fabric each comprising a front panel, a sleeve panel and half a rear panel for the garment.

Figure 2:
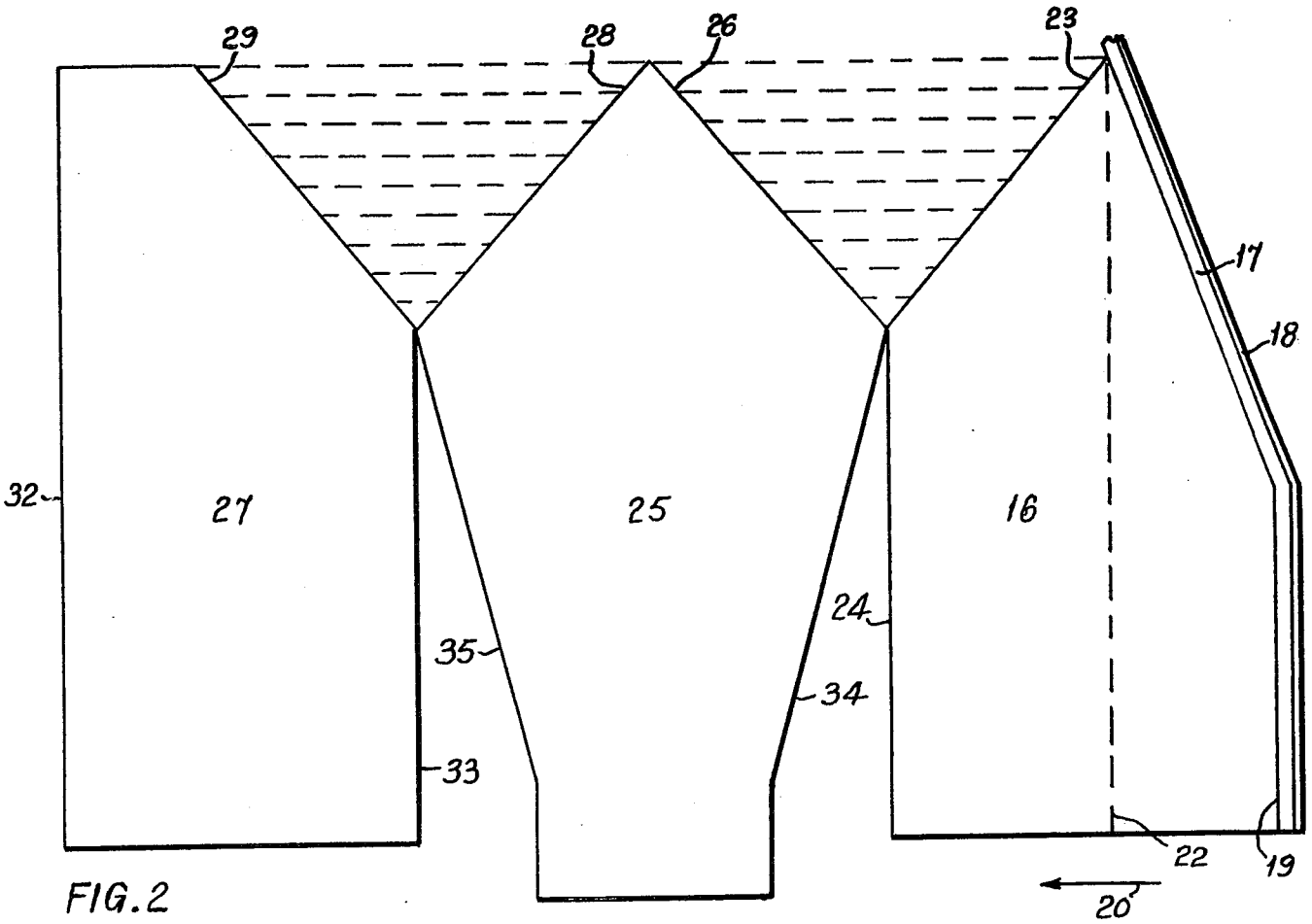
Figure 3:
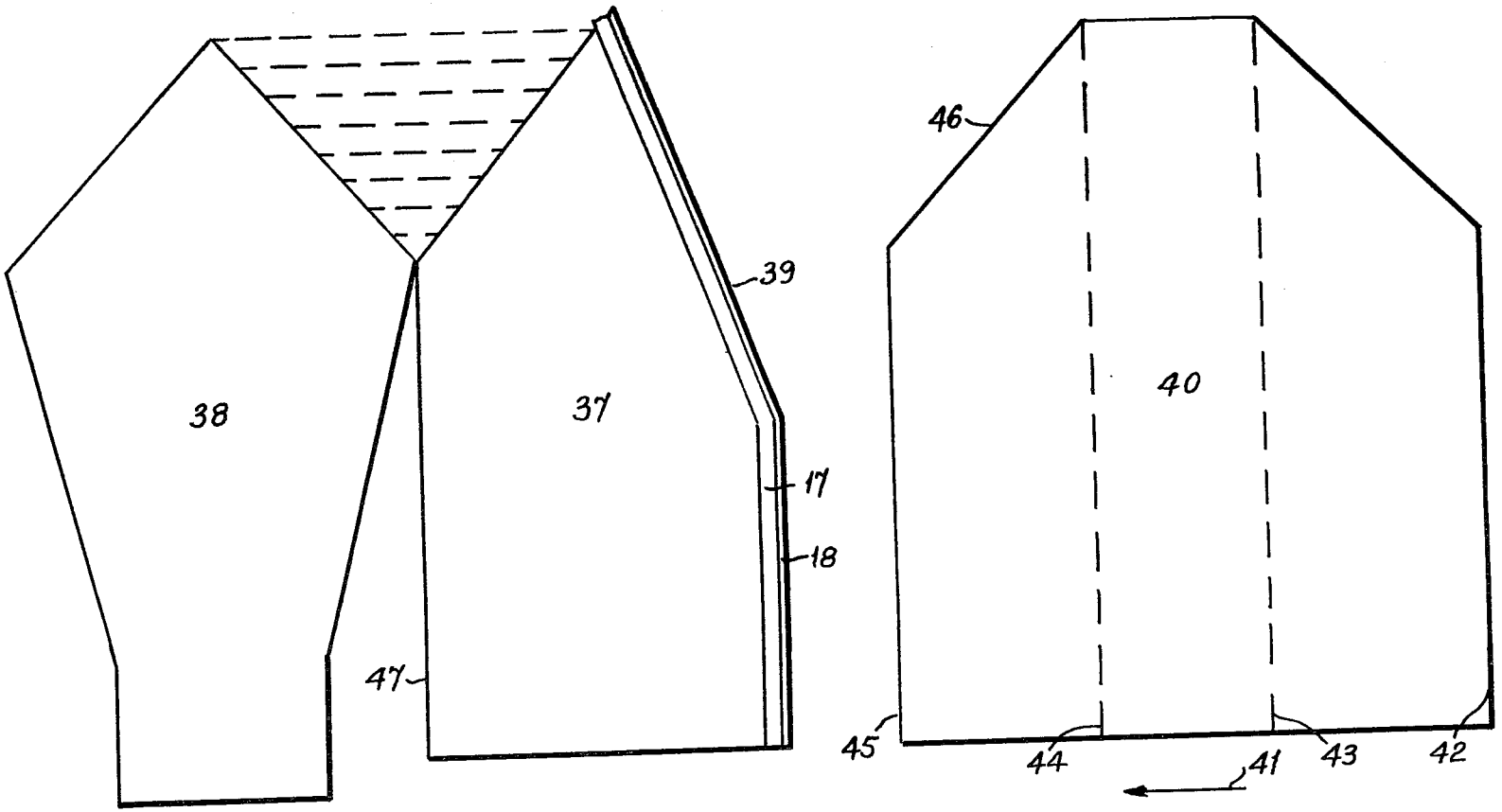
Figure 4:
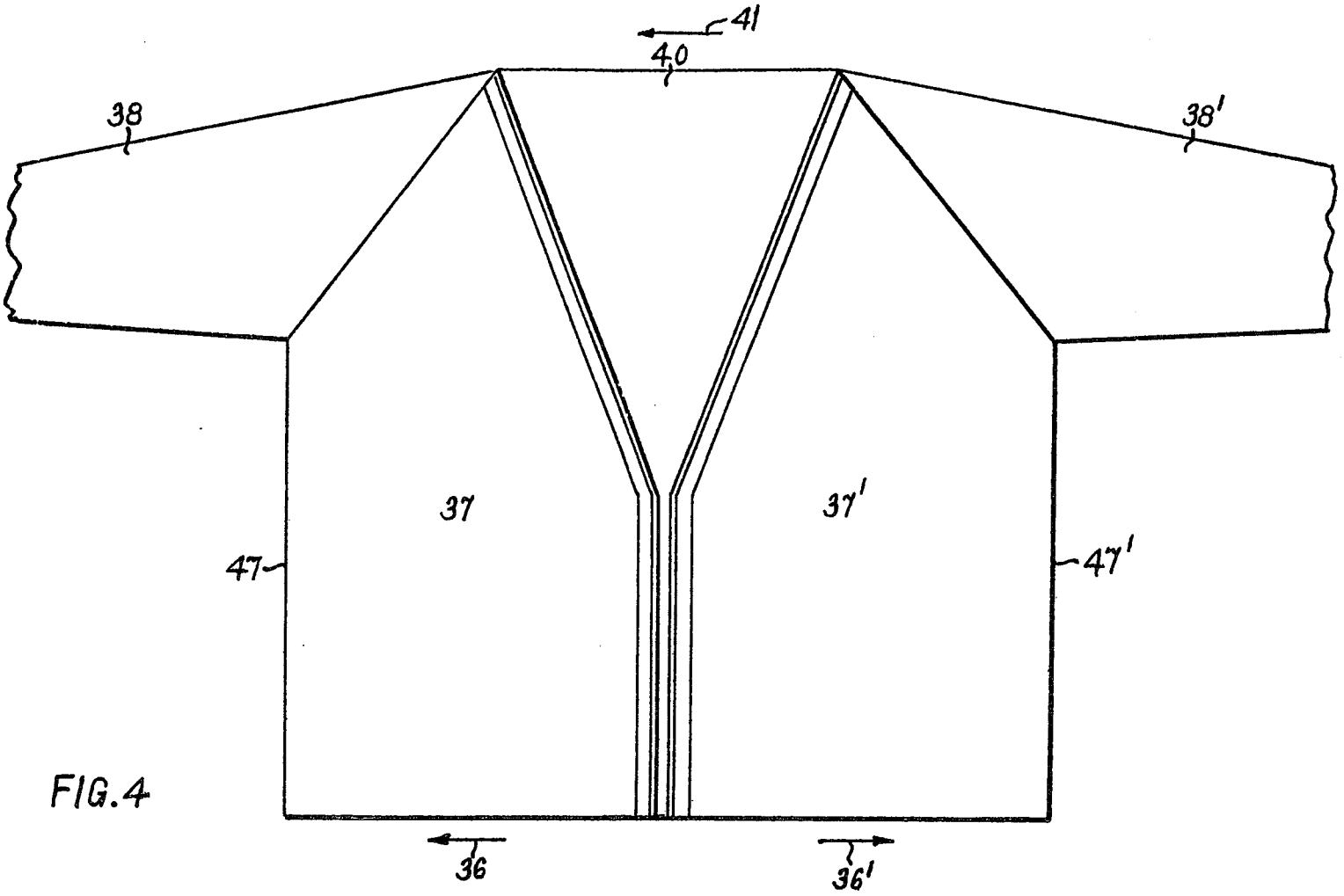

The invention will be further described, by way of example, with reference to the accompanying drawings in which:

FIG. 1 shows a body panel of a garment according to the invention,

FIG. 2 shows a body panel of a garment according to the invention integrally joined to a sleeve panel and to a further part of a panel, FIG. 3 shows a body panel of a garment according to the invention integrally joined to a sleeve panel and adjacent a further body panel suitable for attachment to the sleeve panel, and FIG. 4 is a front view of a garment made by the method described with reference to FIG. 3.

In knitting the garment panels shown in the drawings a knitting machine is used having two opposed needle beds, individually operable needles and means for pushing down the fabric which allows knitting to be carried out on some needles whilst other adjacent needles are inactive but hold loops of the knitted fabric. Such means serve in place of conventional take-down rollers and may be as described in British Pat. No. 1,288,043. A commercially available knitting machine which can be used for knitting the panels shown in the drawings, when adapted by fitting to it a mechanism as described in British Pat. No. 1,288,043, is the machine manufactured by Edouard Dubied & Cie. of Neuchatel, Switzerland and designated by them the "JDR".

The knitted panel 5 shown in FIG. 1 is a front body panel for a jacket. It is knitted commencing with an edge portion 6 which is started by knitting non-run set up courses 7, for example a tubular or roll welt.

When the set-up courses 7 have been completed, knitting of the edge portion 6 is continued in a rib structure, for example full milano, on both beds of the knitting machine using all the needles holding loops. Use of a rib structure in the edge portion 6 helps resist curling of the fabric. On completion of the edge portion 6, knitting is continued in a different stitch structure, for example half milano, or single jersey, to knit the main part of the panel 5.

The edge portion 6 need not be distinguished from the main part of the panel by stitch structure but may be distinguished from the main part of the panel 5 solely by the colour of the yarn in the edge portion. Alternatively, both colour of yarn used and stitch structure may be different in the edge portion and the main part of the panel. The edge portion 6 may consist solely of the set-up courses 7.

When the course 8 has been knitted, the courses of the panel are successively-decreased in length by taking needles out of action progressively. The inactive needles still hold their loops and when the panel 5 is completed, all the needles holding loops are operated to cast off their loops and free the panel 5 from the needles. The resulting panel 5 with the integral edge portion 6, including the set-up courses 7 serving as an edging, is ready for incorporation in a garment, together with a similar mirror image panel.

In the making up procedure, the line 9 will be joined to a similar line in a sleeve panel for the garment.

The knitting machine may be programmed to mark the fabric, for example by knitting tuck stitches at points 12 in the edge portion 6 wherein buttonholes are to be formed or buttons are to be attached.

By supplying differently coloured yarn to the needles for a number of courses, stripes may be formed in the panel 5. The edge portion 6 of the panel 5 is intended to be the edge of the front opening of a jacket and the side edge 13 is intended to be the line of a body side seam of the jacket extending up to the arm pit 14. Thus, the courses of the panel run up-and-down when the panel is worn as part of a garment, whereas the wales are then horizontal.

The panel 15 is made up into a jacket by seaming it to a sleeve panel along the line 9 and to a rear panel (not shown) for the garment along the edge 13, the sleeve panel being also seamed to the rear panel. The rear panel is also seamed to another sleeve panel and to a further front panel which is a mirror image of the panel 5. The starting line of the set up courses 7 of the panel 5 and a corresponding starting line of the mirror image panel will be located in a central region of the front of the garment and will extend up-and-down in the garment. In each of the two panels the wales will extend horizontally from the starting line to an associated side of the garment front, i.e. the side 13 for the panel 5.

In order to reduce the number of seams required in the making up procedure, a panel knitted as described above may be joined integrally in the knitting process with other panels of the garment, for example a sleeve panel and, if desired, also with a rear garment panel, or part of a rear garment panel as illustrated in FIG. 2. In that Figure is shown a front body panel 16 knitted commencing with an edge portion 17 including set-up courses comprising a welt 18. The knitting proceeds in the direction of the arrow 20 so that the courses extend up-and-down in the garment when worn, and the wales extend horizontally.

When the welt 18 has been completed, knitting of the edge portion 17 is continued in a rib structure, for example full milano, on both beds of the knitting machine using all the needles holding loops of the welt. On completion of the edge portion 17, knitting is continued in a different stitch structure, for example half milano, to knit the main part of the panel 16 starting with a course 19 which is not quite half the length of the courses of the edge portion 17. In subsequent courses of the panel, inactive needles which are still holding loops of the edge portion 17 which are taken out of action to knit the course 19 are brought back into knitting action progressively so that the courses of the panel 16 thus increase in length successively and the panel 16 is thereby shaped as shown.

From the course 22 onwards, needles are taken progressively out of action along the line 23 but loops are held on the needles made inactive. At the course 24, needles may be operated to cast off the loops held on the active needles knitting this course, or knitting may be continued from this course 24 to form a few courses of knitting, which may be in waste yarn, before knitting of a sleeve panel 25 is begun. If the loops of the course 24 are cast off their needles, then knitting of the sleeve panel 25 is started up on bare needles. As the sleeve panel 25 is knitted, needles holding loops in the line 23 are progressively brought back into action so that the sleeve panel 25 is integrally joined to the body panel 16. Joining and shaping of the panels 16 and 25 is thus carried out by taking needles progressively out of action (along the line 23) and reintroducing them along the line 26. This causes the wales of the two panels 16 and 25 to lie at an angle to each other in the finished garment, the change of direction occurring along the lines 23 and 26 which are coincident.

Knitting is later continued to join the sleeve panel 25 to a panel 27 constituting half a rear panel for the garment. Joining and shaping of the panels 25 and 27 is carried out by taking needles progressively out of action along the line 28 and reintroducing them along the line 29 as in the case of the lines 23 and 26.

When the half panel 27 has been completed, the needles holding loops of its final course 32 may be operated to cast off their loops and thus release the three panels from the knitting machine, or knitting may be continued using separating courses, which may be in waste yarn, before a further similar series of panels is begun.

To produce a completed jacket, a series of panels constituting a mirror image of the panels shown in FIG. 2 is produced and the two series of panels are joined together by seaming or linking the two half panels together up the centre of the back of the garment along the course 32. The course 24 of the panel 16 is also seamed to the first course 33 of the panel 27 and the edges 34 and 35 of the sleeve panel 25 are seamed together to form a sleeve. Similar seams are made in the mirror image panels (not shown).

FIG. 3 illustrates an alternative method of making a garment in accordance with the invention and FIG. 4 shows a garment made by the method. In this method a front body panel 37 is knitted integrally with a sleeve panel 38 in a manner as described in relation to the panels 16 and 25 of FIG. 2 the direction of knitting being indicated in FIG. 4 by the arrow 36.

The panel 37 is started by non-run set-up courses at a line 39 running up-and-down in the finished garment, when worn. A further front body panel 37' and sleeve panel 38' (see FIG. 4) which are mirror images of the panels 37 and 38 are also knitted, the direction of knitting being indicated in FIG. 4 by the arrow 36'. A rear garment panel 40 is knitted in the direction of the arrow 41 starting with course 42 and progressively increasing the course length up to the course 43 and then progressively decreasing the course length from course 44 to the final course 45 of the panel 40 whereupon the needles holding loops of the course 45 and needles holding loops along the line 46, if these have not been cast off previously, may be operated to cast off their loops. Alternatively, separating courses may be knitted before another garment panel is begun.

The garment is completed by seaming the course 45 of the rear panel 40 to the edge 47 of the front panel 37 and similarly seaming the course 42 of the rear panel 40 to a side edge 47' of the mirror image front panel 37' (see FIG. 4). Free edges of the sleeve panels are also seamed to one another.

What is claimed is:

1. A method of manufacturing a knitted garment to cover at least the upper body, on a knitting machine having needles, said method comprising the steps of (a) knitting two front panels so that said panels together constitute the front of the garment and so that each panel starts from a non-run set-up along an edge thereof and has wales extending from said edge, (b) shaping said panels on said knitting machine during knitting by changing the number of neeldes in action, and (c) incorporating said panels in a garment so that each of said set-ups is located in the front of the garment and extends along an up-and-down line therein, said wales of each panel extending horizontally to an associated side of the garment front.

2. A method as claimed in claim 1 wherein each of said front panels is shaped during knitting and said shaping is effected by:

(a) knitting an edge portion of the panel comprising said non-run set-up, (b) knitting on from said edge portion on some only of needles holding loops of said edge portion whilst maintaining inactive further needles holding loops of the edge portion, and (c) introducing said inactive needles holding loops of the edge portion into knitting action subsequently during the knitting process thereby shaping the panel.

3. A method as claimed in claim 2 including the step of additionally shaping each of said front panels along an edge separate from said edge portion, wherein said additional shaping is effected by taking needles out of action during the knitting process whereby knitting of wales on those needles is halted.

4. A method as claimed in claim 2 further including the steps of:

(a) taking said needles out of action progressively along a sleeve-body join line at an edge of the panel and holding the knitted loops on the needles thus made inactive, (b) bringing said inactive needles back into action progressively to knit a sleeve panel for the garment, (c) continuing knitting to complete said sleeve panel and (d) incorporating said front panels and integral sleeve panels in a garment.

5. A method as claimed in claim 4 wherein during knitting of at least one of said sleeve panels, needles holding loops of the sleeve panel are taken out of action progressively along a further sleeve-body join line at an edge of the panel and needles made inactive are brought back into action progressively to knit at least a part of a further body panel for the garment.

6. A knitted garment to cover at least the upper body, said garment comprising:

(a) two front panels together constituting the front of the garment, each of said front panels having (b) a non-run set-up along the edge of the panel, said edge lying along an up-and-down line in the garment, when worn, (c) wales extending horizontally in the garment, when worn, from said edge to an associated side of said garment front, (d) a sleeve panel integrally knitted with each of said front panels and (e) a rear panel knitted separately from said front and sleeve panels and seamed thereto.

7. A knitted garment to cover at least the upper body, said garment comprising:

(a) two front panels together constituting the front of the garment, each of said front panels having (b) a non-run set-up along an edge of the panel, said edge lying along an up-and-down line in the garment, when worn, (c) wales extending horizontally in the garment, when worn, from said edge to an associated side of said garment front, (d) a sleeve panel integrally knitted with each of said front panels, and (e) a rear half panel integrally knitted with each of said front panels, said rear half panels being seamed together.

* * * * *